US007988485B2

(12) United States Patent
Zhang et al.

(10) Patent No.: US 7,988,485 B2
(45) Date of Patent: Aug. 2, 2011

(54) ELECTRICAL CONNECTOR

(75) Inventors: Shuai Zhang, Shenzhen (CN); Yan-Yan Cao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/791,872

(22) Filed: Jun. 2, 2010

(65) Prior Publication Data

US 2011/0076872 A1 Mar. 31, 2011

(30) Foreign Application Priority Data

Sep. 29, 2009 (CN) ..... 2009 1 0307965

(51) Int. Cl.
*H01R 13/62* (2006.01)

(52) U.S. Cl. ..... 439/372; 439/953

(58) Field of Classification Search ..... 439/372, 439/953, 254, 353
See application file for complete search history.

(56) References Cited

U.S. PATENT DOCUMENTS 4,709,975 A * 12/1987 Williams, II ..... 439/350
5,106,321 A * 4/1992 Haroutel ..... 439/310
5,109,453 A * 4/1992 Edwards et al. ..... 385/90
6,579,114 B2 * 6/2003 Lord ..... 439/358
6,869,301 B2 * 3/2005 Shimizu et al. ..... 439/324
6,945,666 B2 * 9/2005 Woolfson ..... 362/183
7,008,255 B1 * 3/2006 Wang ..... 439/357
7,285,005 B2 * 10/2007 Gabrielsson et al. ..... 439/378

OTHER PUBLICATIONS

"Latch-Up Protection for MOSFET Drivers," Microchip Technology Inc., 2003, DS00763B, pp. 1-6.

* cited by examiner

*Primary Examiner* — Phuong K Dinh
(74) *Attorney, Agent, or Firm* — Zhigang Ma

(57) ABSTRACT

An electrical connector includes a base and a fixing assembly. The assembly includes a shaft, at least one positioning post, and at least one connecting bar. The shaft is slidably connected to the base and able to slide toward a first direction. The at least one positioning post is slidably connected to the base and able to slide toward a second direction. A threaded pole protrudes from each of the at least one positioning post. Ends of each of the at least one connecting bar is rotatably connected to the shaft and one of the at least one positioning post, respectively. The sliding of the shaft toward the first direction causes the at least one positioning post to slide toward the second direction, and when the shaft is caused to slide from a first position to a second position, the at least one threaded pole engages another electrical connector.

11 Claims, 5 Drawing Sheets

ELECTRICAL CONNECTOR

BACKGROUND

1. Technical Field

The present disclosure relates to electrical connectors and, particularly, to an electrical connector having a fixing assembly to detachably connect the electrical connector to another electrical connector.

2. Description of Related Art

For connecting some kinds of electrical connectors, for example VGA connectors, screwing together threaded parts of the connectors which are relatively long is usually troublesome and time consuming.

BRIEF DESCRIPTION OF THE DRAWINGS

The components of the drawings are not necessarily drawn to scale, the emphasis instead being placed upon clearly illustrating the principles of an electrical connector. Moreover, in the drawings, like reference numerals designate corresponding parts throughout several views.

DETAILED DESCRIPTION

Figure 1:
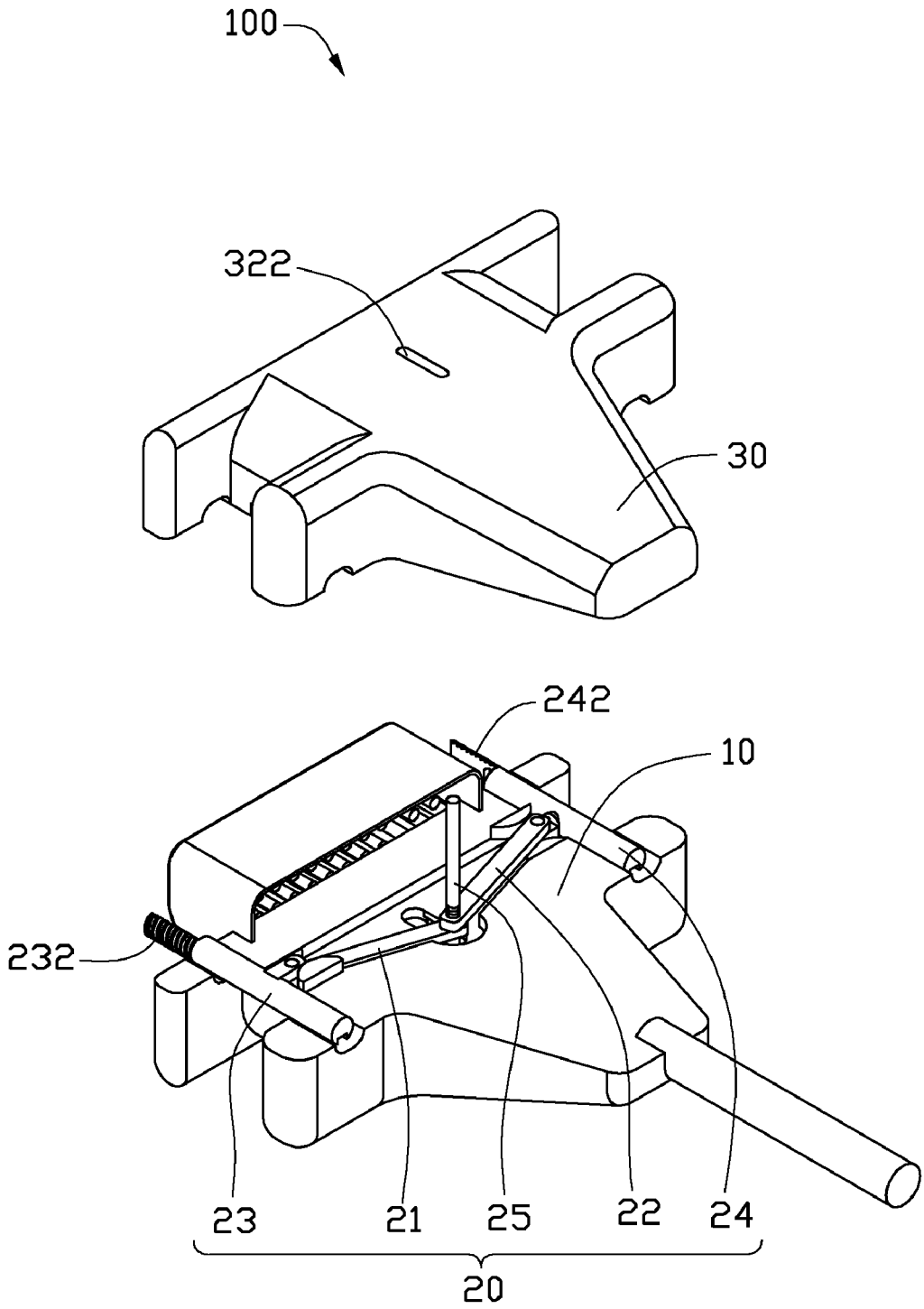
FIG. 1 is a partially exploded, perspective view of an electrical connector in accordance with an exemplary embodiment.

Referring to FIG. 1, an electrical connector 100 includes a base 10, a fixing assembly 20, and a cover 30. The base 10 cooperates with the cover 30 to form an interior space to receive the fixing assembly 20. The fixing assembly 20 is employed to detachably fix the electrical connector 100 to another electrical connector (not shown). In the embodiment, the another electrical connector includes two threaded holes, and the electrical connector 100 is fixed to the another electrical connector by the engagement of threaded portions.

Figure 2:
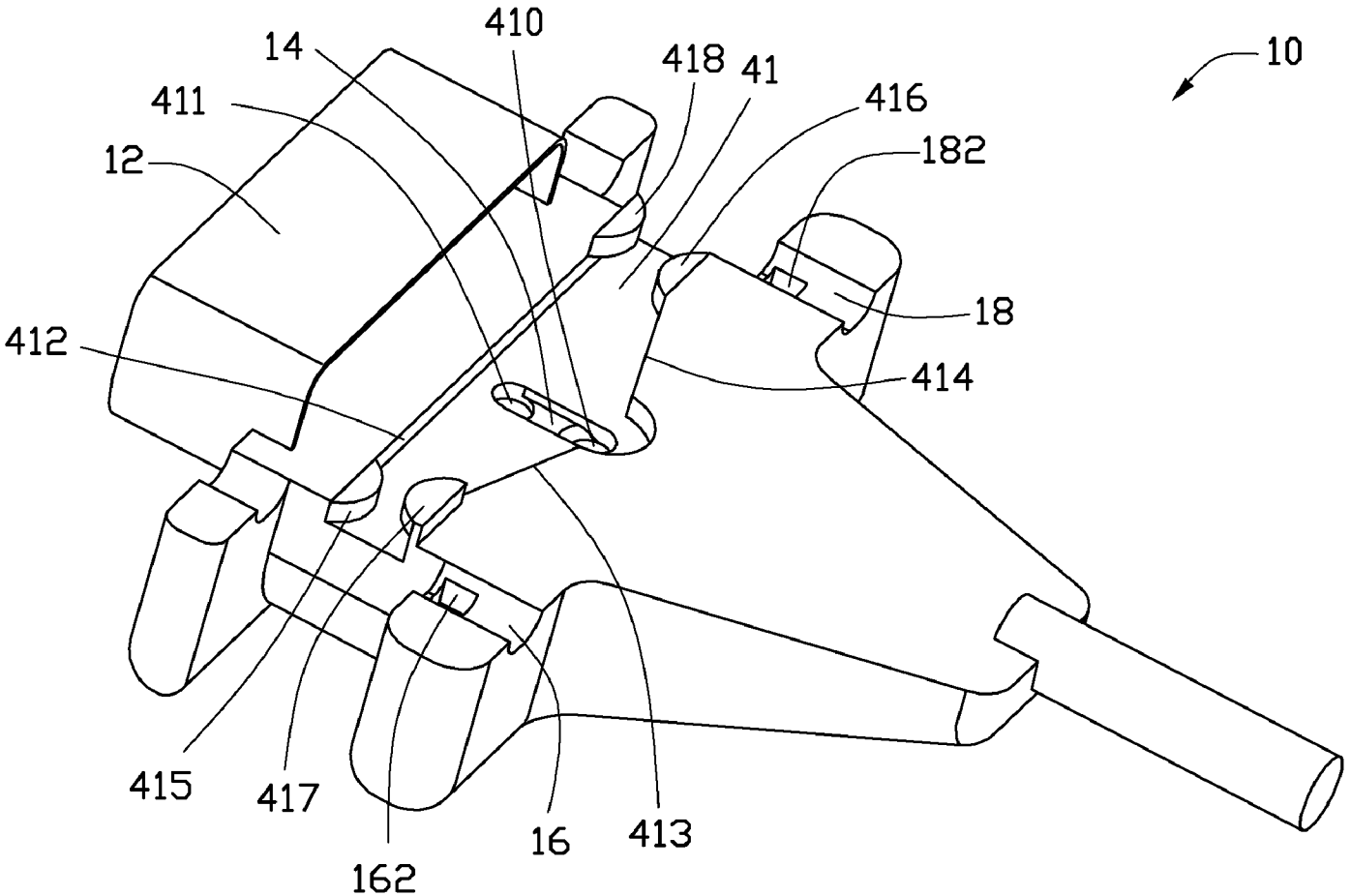
FIG. 2 is an isometric view of a base of the electrical connector of FIG. 1.

Referring also to FIG. 2, a plug 12, substantially cuboid, is mounted on the front end of the base 10. The plug 12 couples to a socket of the another electrical connector. The base 10 defines a first sliding slot 14 and a pair of first recessed portions 16 and 18. The first sliding slot 14 is arranged between and parallel to the first recessed portions 16 and 18. The first sliding slot 14 and the first recessed portions 16 and 18 are substantially perpendicular to a longitudinal side of the plug 12. In the embodiment, the first recessed portions 16 and 18 are substantially semi-cylindrical.

Figure 3:
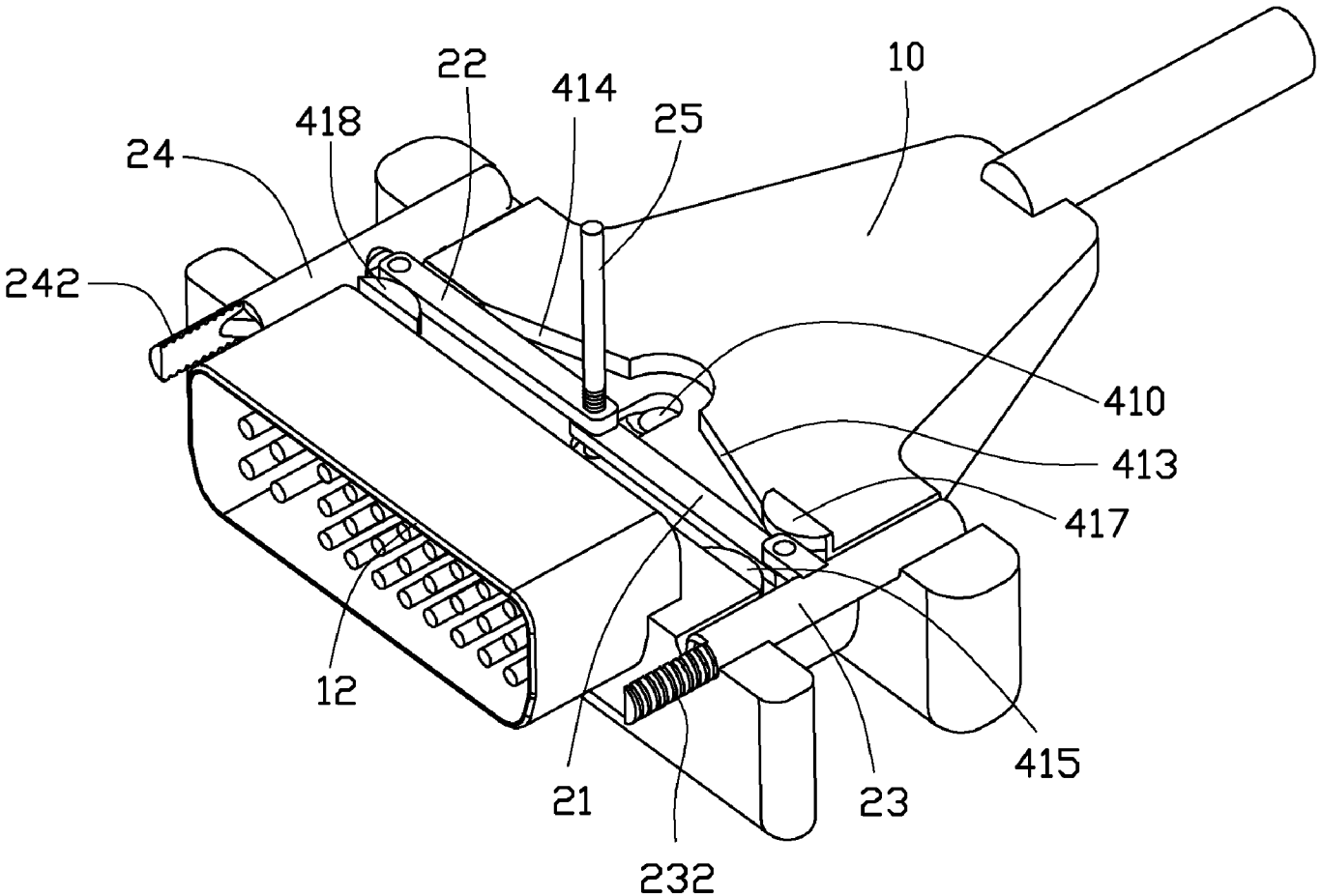
FIG. 3 is an isometric view of the electrical connector of FIG. 1, showing a fixing assembly mounted on the base.
Figure 4:
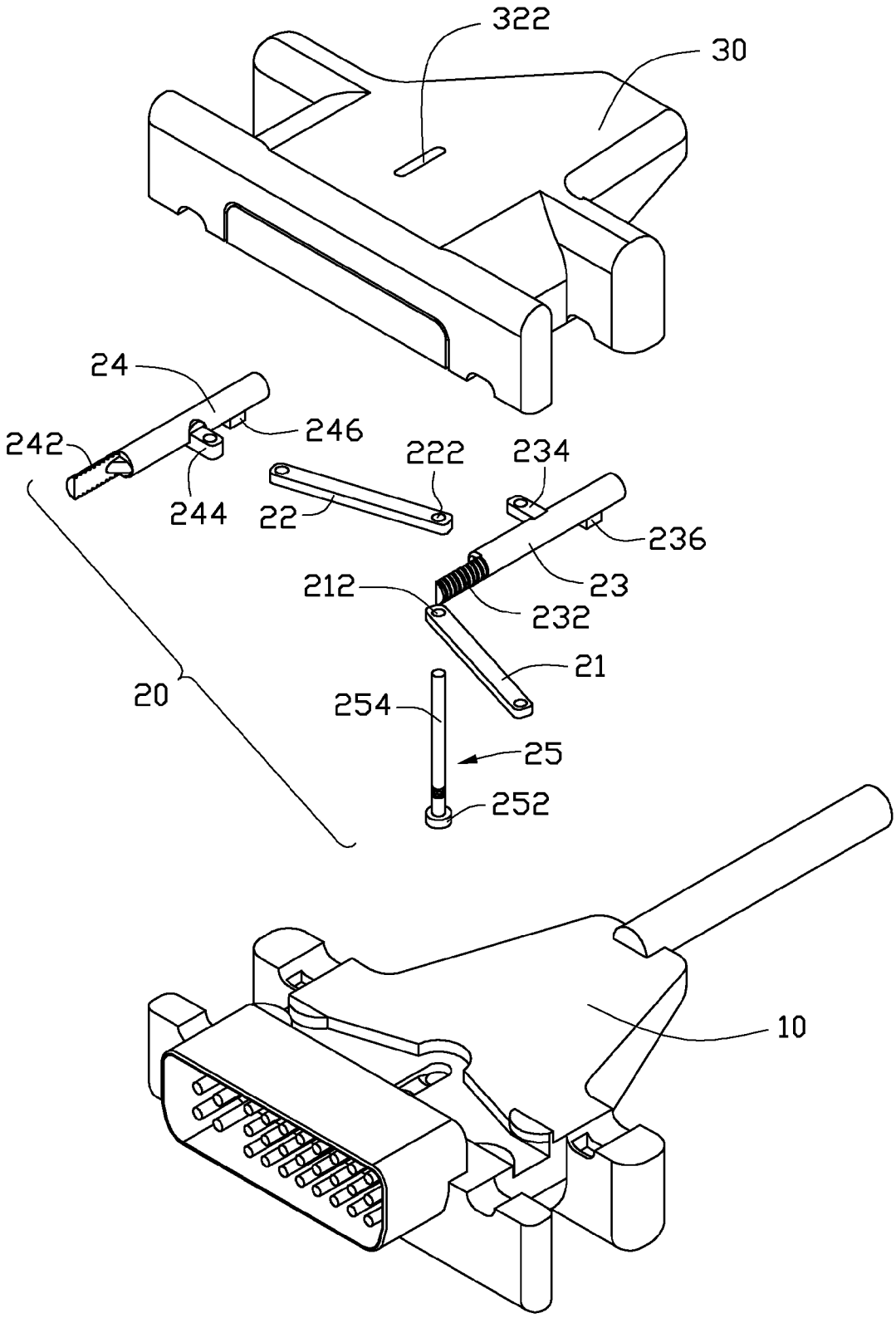
FIG. 4 is an exploded, perspective view of the electrical connector of FIG. 1.

Referring also to FIGS. 3 and 4, the fixing assembly 20 includes a pair of connecting bars 21 and 22, a pair of positioning posts 23 and 24, and a shaft 25. The shaft 25 includes a rod 254 and a head 252 extending radially along the lateral surface of one end of the rod 254. The head 252 is slidably received in the first sliding slot 14 and the shaft 25 can slide toward the plug 12 and away from the plug 12 in the first sliding slot 14. The positioning posts 23 and 24 are slidably received in the first recessed portions 16 and 18, respectively, and can slide toward each other and slide apart from each other. It should be noted that in the embodiment the sliding direction of the shaft 25 is substantially perpendicular to the sliding direction of the positioning posts 23 and 24. Semi-cylindrical threaded poles 232 and 242 protrude from ends of the positioning posts 23 and 24, respectively. The radius of the threaded poles 232 and 242 are substantially equal to that of the threaded holes of the another electrical connector. The threaded poles 232 and 242 can engage the threaded holes, respectively. One end of the connecting bar 21 is rotatably connected to the shaft 25, and an opposite end is rotatably connected to the positioning post 23. One end of the connecting bar 22 is rotatably connected to the shaft 25, and an opposite end is rotatably connected to the positioning post 24.

When fixing the electrical connector 100 to the another electrical connector, a first step is to insert the plug 12 into the socket and place the threaded poles 232 and 242 into the threaded holes of the another electrical connector, respectively. A second step is to slide the shaft 25 toward the plug 12 in the sliding slot 14, causing the positioning posts 23 and 24 to move apart from each other until the threaded poles 232 and 242 engage the threaded holes, respectively. At this point, the electrical connector 100 is fixed to the another electrical connector.

To separate the electrical connector 100 from the another electrical connector, the shaft 25 is slid away from the plug 12 in the sliding slot 14, causing the positioning posts 23 and 24 to move towards each other until the threaded poles 232 and 242 disengage from the threaded holes, respectively. At this point, the electrical connector 100 can be pulled out of the another electrical connector.

For better understanding the present disclosure, the following paragraphs give detailed description illustrating the structure of the electrical connector 100.

The top of the base 10 defines a first receiving space 41. The first receiving space 41 communicates with the first recessed portions 16 and 18. The first sliding slot 14 is formed in the bottom of the first receiving space 41. A pair of positioning holes 410 and 411 is formed in the bottom of the sliding slot 14. The positioning hole 411 is adjacent to the plug 12. Magnets (not shown) are mounted in the positioning holes 410 and 411, respectively. The head 252 of the shaft 25 can be attracted by the magnets. In the embodiment, when the connector 100 is plugged into the another electrical connector, the head 252 is received in the positioning hole 410, the threaded poles 232 and 242 are disengaged from the threaded holes of the another electrical connector. When the head 252 is received in the positioning hole 411, the threaded poles 232 and 242 are engaged with the threaded holes of the another electrical connector.

The first receiving space 41 includes sidewalls 412, 413, and 414. The sidewall 412 opposes to the plug 12 and the sidewalls 413 and 414 face the sidewall 412. The angle between the sidewalls 413 and 414 is greater than zero degree but less than 180 degrees. The first sliding slot 14 is arranged between the sidewalls 413 and 414.

Four semi-cylindrical resisting blocks 415, 416, 417, 418 protrude from the first receiving space 41. The resisting block 415 protrudes from the sidewall 412 contacting the bottom of the receiving space 41 and adjacent to the recessed portion 16. The resisting block 417 protrudes from the top of the sidewall 413 and faces the resisting block 415. The resisting block 416 protrudes from the sidewall 414 contacting the bottom of the receiving space 41 and adjacent to the recessed portion 18. The height of the resisting block 416 is slightly less than that of the sidewall 414. The resisting block 418 protrudes from the top of the sidewall 412 and faces the resisting block 416. The distance between the resisting blocks 415 and 417 is substantially equal to the distance between the resisting blocks 416 and 418.

The bottom of the first recessed portions 16 and 18 define apertures 162 and 182, respectively. In the embodiment, the apertures 162 and 182 are generally square.

Figure 5:
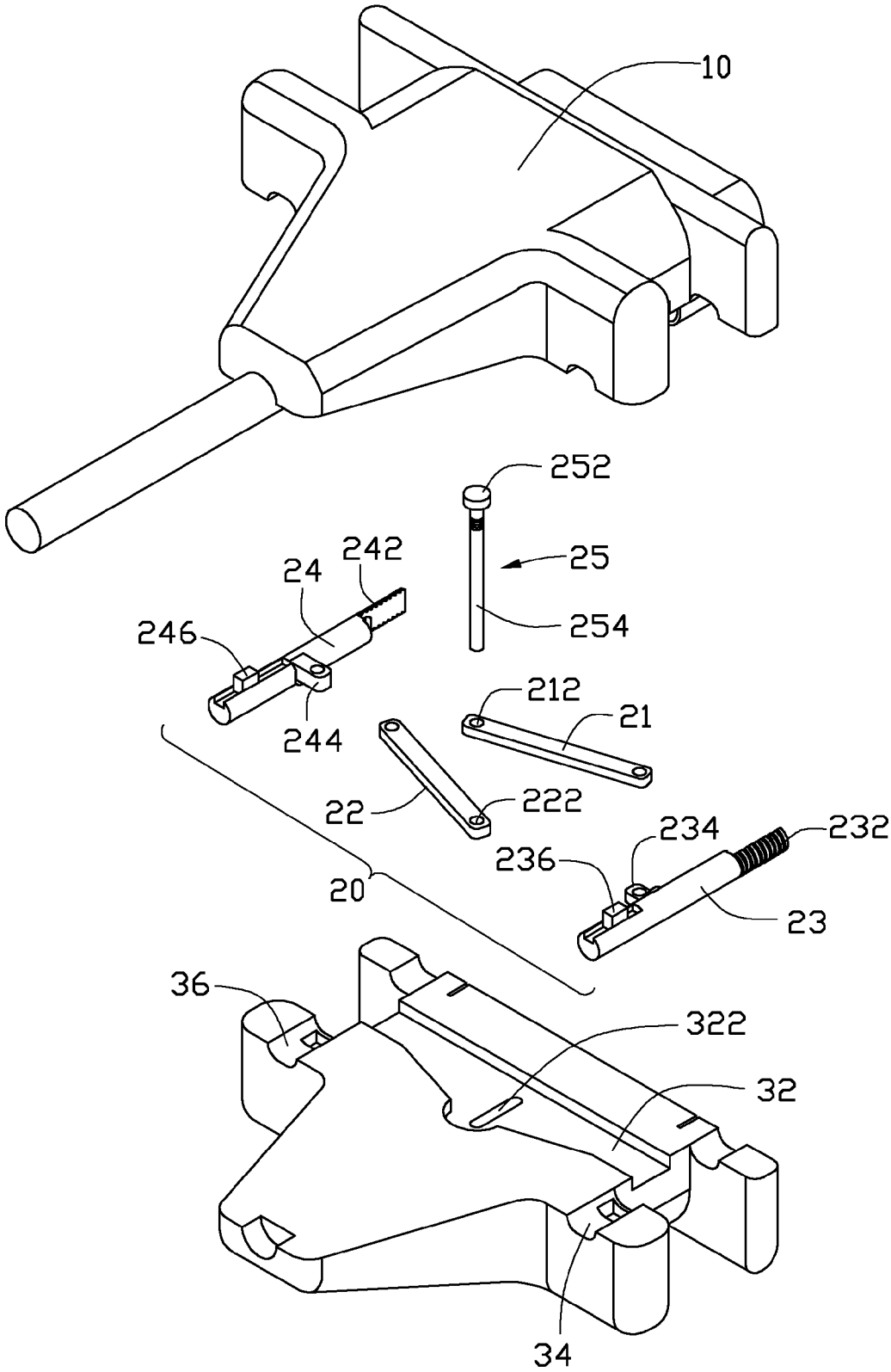
FIG. 5 is another exploded, perspective view of the electrical connector of FIG. 1, viewed from another viewpoint.

Referring also to FIG. 5, the width of the connecting bars 21 and 22 are substantially equal to the distance between the resisting blocks 415 and 417. One end of the connecting bar 21 defines a shaft hole 212, and one end of the connecting bar 22 defines a shaft hole 222. The rod 254 can extend through the shaft holes 212 and 222.

A connecting block 234 and a connecting block 244 protrude from the lateral surface of the positioning posts 23 and 24, respectively. The width of the connecting blocks 234 and 244 are substantially equal to the distance between the resisting blocks 415 and 417. The height of the connecting block 234 is substantially equal to that of the sidewall 413, and the height of the connecting block 244 is substantially equal to that of the resisting block 416.

A sliding block 236 and a sliding block 246 further protrude from the lateral surface of the positioning posts 23 and 24 and are substantially perpendicular to the connecting blocks 234 and 244, respectively. The sliding blocks 236 and 246 can be received in the apertures 162 and 182, respectively, to guide the movement of the positioning posts 23 and 24, respectively.

The cover 30 and the base 10 fit together to house the components of the electrical connector 100. The cover 30 defines a second receiving space 32 corresponding to the first receiving space 41, a second sliding slot 322 corresponding to the first sliding slot 14, and second recessed portions 34 and 36 corresponding to the first recessed portions 16 and 18, respectively.

While assembling the electrical connector 100, a first step is to place the head 252 of the shaft 25 in the positioning hole 410. Due to the magnet, the shaft 25 is fixed in the positioning hole 410. A second step is to pass the rod 254 through the shaft hole 212 of the connecting bar 21 to cause the connecting bar 21 to be received in the first receiving space 41 and resists the resisting block 415. As the height of the connecting bar 21 is substantially equal to that of the sidewall 413, the connecting bar 21 is below the resisting block 417 and the resisting block 417 cannot limit the movement of the connecting bar 21. A third step is to place the positioning post 23 in the first recessed portion 16 to cause the sliding block 236 to be receive in the aperture 162 and the connecting block 234 to be on the connecting bar 21, and further employ a fixing element (not shown) to rotatably connect the positioning post 23 to the connecting bar 21. A fourth step is to place the positioning post 24 in the first recessed portion 18 to cause the sliding block 246 to be received in the aperture 182 and the connecting block 244 to be arranged between the resisting blocks 416 and 418. A fifth step is to pass the rod 254 through the shaft hole 222 of the connecting bar 22 to cause one end of the connecting bar 22 to be on the connecting block 244, and further employ a fixing element (not shown) to rotatably connect the positioning post 24 to the connecting bar 22. As the height of the connecting block 246 is substantially equal to that of the resisting block 418 and the height of the resisting block 418 is less than that of the sidewall 414, the connecting bar 22 is above the resisting block 418 and the resisting block 418 cannot limit the movement of the connecting bar 22. The cover 30 is then secured to the base 10 to cause the rod 254 to pass through the second sliding slot 322.

When fixing the electrical connector 100 to the another electrical connector, the head 252 of the shaft 254 is pulled out of the positioning hole 410 and the rod 254 is pushed to slide toward the plug 12 along the first sliding slot 322. The slide of the shaft 25 causes the positioning posts 232 and 242 to slide apart from each other. When the head 252 is caused to be received in the positioning hole 411, the threaded poles 232 and 242 engage the threaded holes of the another electrical connector.

In simple terms, the connector 100 has switch that can be manually operated to push threaded portions of the connector 100 against threaded portions of the another connector to engage the connectors with each other without having to screw the threaded portions together with a tool or with fingertips. The connector 100 is much easier for users to operate than previous connectors.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electrical connector capable of being detachably connected to another electrical connector, comprising:

a base; and a fixing assembly comprising:

a shaft slidably connected to the base and able to slide toward a first direction along the base;

at least one positioning post slidably connected to the base and able to slide toward a second direction along the base, a threaded pole protruding from one end of each of the at least one positioning post; and at least one connecting bar, two opposite ends of each of the at least one connecting bar being rotatably connected to the shaft and one of the at least one positioning post, respectively;

wherein the sliding of the shaft toward the first direction causes the at least one positioning post to slide toward the second direction, and when the shaft slides toward the first direction from a first position to a second position, the at least one threaded pole engages the another electrical connector.

2. The electrical connector as described in claim 1, wherein the base defines a first sliding slot, the shaft comprise a head received in the first sliding slot and able to slide toward the first direction in the first sliding slot.

3. The electrical connector as described in claim 2, wherein a bottom of the first sliding slot defines a first positioning hole and a second positioning hole, when the head is positioned in the first positioning hole, the shaft is in the first position, and when the head is positioned in the second positioning hole, the shaft is in the second position.

4. The electrical connector as described in claim 2, wherein the base defines at least one first recessed portion, each of the at least one positioning post is slidably received in one of the at least one first recessed portion and able to slide toward the second direction in the one of the at least one first recessed portion.

5. The electrical connector as described in claim 4, wherein a bottom of each of the at least one first recessed portion defines an aperture, each of the at least one positioning post comprises a sliding block, each of the at least one sliding block is received in one of the at least one aperture to guide the slide of the at least one positioning post.

6. The electrical connector as described in claim 4, wherein each of the at least one positioning post comprises a connecting block rotatably connected to one of the at least one connecting bar.

7. The electrical connector as described in claim 4 further comprising a cover defining a second sliding slot and at least one second recessed portion, wherein the second sliding slot corresponds to the first sliding slot, and each of the at least one second recessed portion corresponds to one of the at least one first recessed portion.

8. The electrical connector as described in claim 7, wherein the shaft comprise a rod passing through the second sliding slot and able to slide toward the first direction in the second sliding slot.

9. The electrical connector as described in claim 1, wherein the first direction is substantially perpendicular to the second direction.

10. The electrical connector as described in claim 1, wherein the at least one threaded pole is substantially semi-cylindrical.

11. An electrical connector capable of being detachably connected to another electrical connector, comprising:

a base; and a fixing assembly comprising:

a shaft slidably connected to the base and able to slide toward a first direction along the base;

at least one positioning post slidably connected to the base and able to slide toward a second direction along the base, the second direction being substantially perpendicular to the first direction, an engaging portion protruding from one end of each of the at least one positioning post; and at least one connecting bar, two opposite ends of each of the at least one connecting bar being rotatably connected to the shaft and one of the at least one positioning post, respectively;

wherein the sliding of the shaft toward the first direction causes the at least one positioning post to slide toward the second direction, and when the shaft slides toward the first direction from a first position to a second position, the at least one engaging portion engages the another electrical connector.

* * * * *